US007638193B1

(12) United States Patent
Rebouillat et al.

(10) Patent No.: US 7,638,193 B1
(45) Date of Patent: Dec. 29, 2009

(54) CUT-RESISTANT YARNS AND METHOD OF MANUFACTURE

(75) Inventors: Serge Rebouillat, Echenevex (FR); Stephen Donald Moore, Powhatan, VA (US); Benoit Steffenino, St. Julien en Genevois (FR)

(73) Assignee: E. I. du Pont de Nemours and Company, Wilmington, DE (US)

( * ) Notice: Subject to any disclaimer, the term of this patent is extended or adjusted under 35 U.S.C. 154(b) by 340 days.

(21) Appl. No.: 11/545,659

(22) Filed: Oct. 10, 2006

(51) Int. Cl.
*B32B 9/00* (2006.01)

(52) U.S. Cl. ..... 428/373; 428/370; 57/210

(58) Field of Classification Search ..... 428/296.7, 428/373, 370
See application file for complete search history.

(56) References Cited

U.S. PATENT DOCUMENTS

| | | | |
|---|---|---|---|
| 3,094,511 | A | 6/1963 | Hill, Jr. et al. |
| 3,354,127 | A | 11/1967 | Hill, Jr, et al. |
| 3,673,143 | A | 6/1972 | Bair et al. |
| 3,819,587 | A | 6/1974 | Kwoleck |
| 3,869,429 | A | 3/1975 | Blades |
| 4,073,837 | A | 2/1978 | Kouzai et al. |
| 4,078,034 | A | 3/1978 | Lewis |
| 4,172,938 | A | 10/1979 | Mera et al. |
| 4,228,118 | A | 10/1980 | Wu et al. |
| 4,276,348 | A | 6/1981 | Wu et al. |
| 4,457,985 | A | 7/1984 | Harpell et al. |
| 4,478,083 | A | 10/1984 | Hassler et al. |
| 4,533,693 | A | 8/1985 | Wolfe et al. |
| 4,605,364 | A | 8/1986 | Roth et al. |
| 4,703,103 | A | 10/1987 | Wolfe et al. |
| 4,772,678 | A | 9/1988 | Sybert et al. |
| 4,847,350 | A | 7/1989 | Harris |
| 5,089,591 | A | 2/1992 | Gregory et al. |
| 5,276,128 | A | 1/1994 | Rosenberg et al. |
| 5,674,969 | A | 10/1997 | Sikkema et al. |
| 6,153,545 | A | 11/2000 | LaLonde et al. |
| 2008/0085646 | A1 | 4/2008 | Prickett |

FOREIGN PATENT DOCUMENTS

| | | |
|---|---|---|
| EP | 0 022 065 | 1/1981 |
| EP | 1 424 412 A1 | 6/2004 |
| JP | 60-47922 | 3/1985 |
| JP | 64-8732 | 1/1989 |
| WO | WO 0008410 | 2/2000 |
| WO | WO 2008/001740 A1 | 2/2008 |

OTHER PUBLICATIONS

W. Black et al., Man-Made Fibres—Science and Technology, vol. 2, Section Titled Fibre-Forming Aromatic Polyamides, p. 297, Interscience Publishers, 1968.

*Primary Examiner*—Lynda Salvatore

(57) ABSTRACT

The invention provides yarns made of filaments of different average diameters, having excellent cut-resistance.

20 Claims, 4 Drawing Sheets

CUT-RESISTANT YARNS AND METHOD OF MANUFACTURE

FIELD OF THE INVENTION

The present invention relates to the field of cut-resistant yarns and protective fabrics and garments made therefrom.

BACKGROUND OF THE INVENTION

Cut-resistant yarns are used for making fabrics which resist abrasion, cutting, tearing, penetration and puncture. Such fabrics can be used to manufacture protective garments for workers in various industries working with abrasive materials or sharp objects, as well as for police and military personnel requiring protection against stabbing implements and projectiles.

Cut-resistant yarns can be made from glass, mineral fibres, steel, but increasingly, synthetic polymer fibres are being employed, because they provide excellent cut-resistance, while offering a weight advantage, and a look and feel in the finished fabric that is similar if not identical to regular fabric. Polymers that are used for cut-resistant yarns include, for example, polyamides (e.g., p- and m-aramids), polyolefins (e.g., polyethylene), and polyazoles (e.g., PBO), and PIPD (poly-diimidazol pyridinylene dihydroxy phenylene, "PB").

Yarns made from synthetic polymer fibres are made using various spinning processes, all of which involve the use of a spinneret having multiple small openings, through which a concentrated solution or suspension of the polymer (or molten polymer) is sprayed or extruded. After extrusion, the polymer solidifies (and consolidates) into filaments, which are then spun into a multifilament yarn.

Examples of such spinning processes are described in the prior art. U.S. Pat. No. 4,078,034 discloses a method called "air gap spinning" in which a solution of an aromatic polyamide is extruded from a spinneret into an air gap (approximately 9 mm) before passing into a coagulating bath. In the case of poly(p-phenylene terephthalamide) (p-aramid), the solution consists of 15-25% by weight p-aramid in concentrated $H_2SO_4$, and the coagulating solution contains <20 wt % aqueous $H_2SO_4$, at a temperature which is adjusted to below 35° C. for this quenching step.

In a process used for spinning m-aramid, a concentrated solution of m-aramid in an amide solvent, such as N,N-dimethylacetamide (DMA) is extruded from a spinneret into an aqueous coagulation bath. Such a process is disclosed in U.S. Pat. No. 4,073,837.

The holes in the spinneret head are chosen to produce filaments of the desired number and diameter. Filaments can be extended in air or gas before solidification (often referred to as "spin-stretch"), and/or in a liquid during the quenching/solidification process, and in many products by drawing after the filaments have been initially quenched or solidified. Drawing the filaments will reduce the average diameter. Multiple filaments are spun together to produce a yarn having a final linear density that is a sum of the linear density of each of the filaments.

Although existing synthetic yarns made with conventional spinning processes have excellent cut- and most of the time moderate abrasion-resistance, a need remains for yarns with excellent cut- and improved abrasion-resistance.

SUMMARY OF THE INVENTION

The inventors have found that if filaments having different deniers are spun together into a single yarn, the resulting yarn has excellent cut- and abrasion-resistance.

In a first aspect, the invention provides a yarn, comprising:

a first plurality of continuous filaments, each of the first plurality of filaments having an average diameter in the range of at or about 2 to 25 (preferably 4 to 10) microns/filament;

at least a second plurality of continuous filaments, each of the second plurality of filaments having an average diameter greater than the average diameter of the first plurality of filaments, and in the range of at or about 10 to 40 (preferably 10 to 32) microns/filament; and the first and second plurality of filaments being made of the same polymer selected from the group consisting of an aromatic polyamide, a polyolefin (preferably having a molecular weight above at or about 1 million Da, such as an UHMWPE), PB, and an aromatic polyazole.

In a second aspect, the invention provides a yarn, comprising:

a first filament, having an average diameter in the range of at or about 4 to 25 microns;

a second filament, having an average diameter greater than the average diameter of the first filament, and in the range of at or about 15 to 40 microns/filament; and a plurality of filaments having average diameters distributed between the average diameter of the first filament and the average diameter of the second filament;

wherein all of the filaments are made of the same polymer selected from the group consisting of an aromatic polyamide, a polyolefin (preferably having a molecular weight above at or about 1 million Da, such as an UHMWPE), PB, and an aromatic polyazole.

In a third aspect, the invention provides a yarn, comprising:

a first plurality of continuous filaments, each of the first plurality of filaments having a first nominal linear density in the range of 0.25 to 1.25 denier/filament;

at least a second plurality of continuous filaments, each of the second plurality of filaments having a second nominal linear density greater than the first nominal linear density and in the range of 1.25 to 6 denier/filament; and the first and second plurality of filaments being made of the same polymer selected from the group consisting of an aromatic polyamide, a polyolefin (preferably having a molecular weight of at least 1 million Da), PB, and an aromatic polyazole.

In a fourth aspect, the invention provides a cut-resistant fabric comprising the yarn of the invention.

In a fifth aspect, the invention provides a cut-resistant garment made using the cut-resistant fabric of the invention.

In a sixth aspect, the invention provides a method for making a cut-resistant yarn, comprising the step of:

extruding a polymer selected from an aromatic polyamide, a polyolefin (preferably having a molecular weight of at least 1 million Da), PB, and an aromatic polyazole from a spinneret comprising extrusion holes of a first average diameter and of a second average diameter, wherein the first and second average diameters differ by a factor of at least 1.2.

In a seventh aspect, the invention provides a spinneret for making a cut-resistant yarn, the spinneret comprising extrusion holes of a first average diameter and of a second average diameter, wherein the first and second average diameters differ by a factor of at least 1.2.

DETAILED DESCRIPTION OF PREFERRED EMBODIMENTS

ABBREVIATIONS

UHMWPE: ultra-high molecular weight polyethylene

Figure 1:
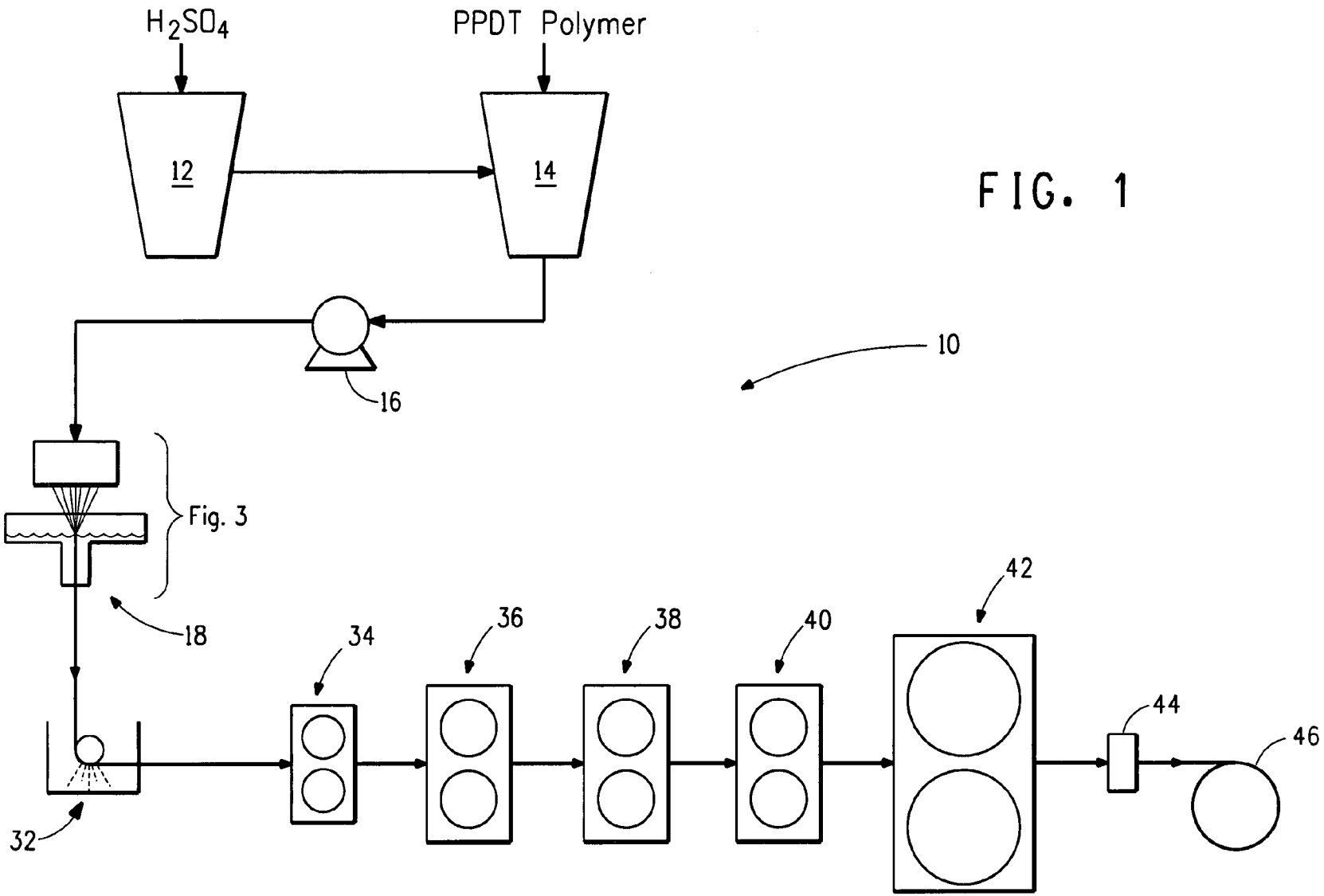
FIG. 1 is a schematic diagram of a process for making yarn of the present invention.
Figure 2A:
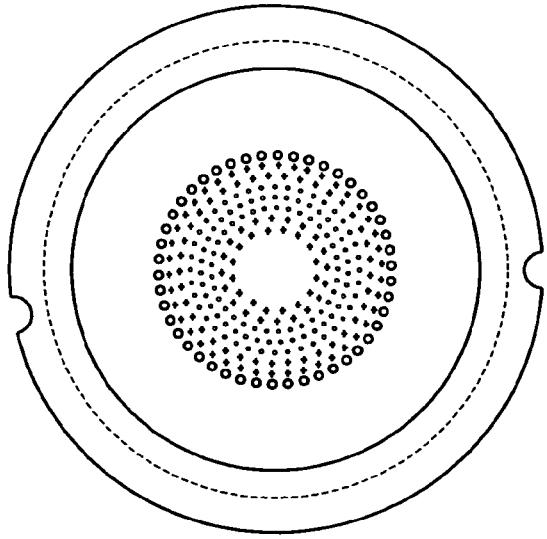
FIGS. 2A-E illustrate spinnerets with various capillary patterns in accordance with the present invention.
Figure 2B:
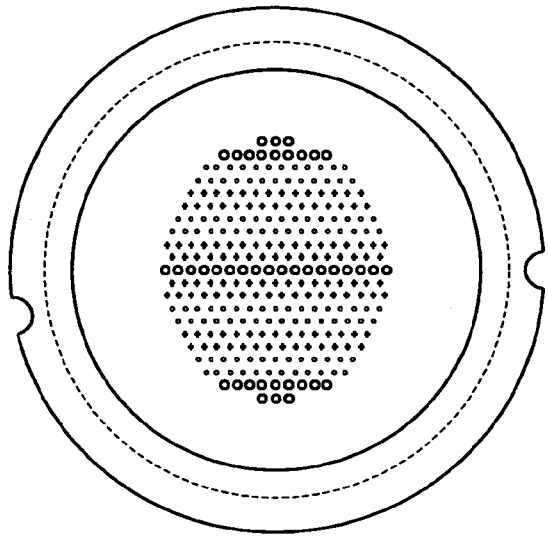
Figure 2C:
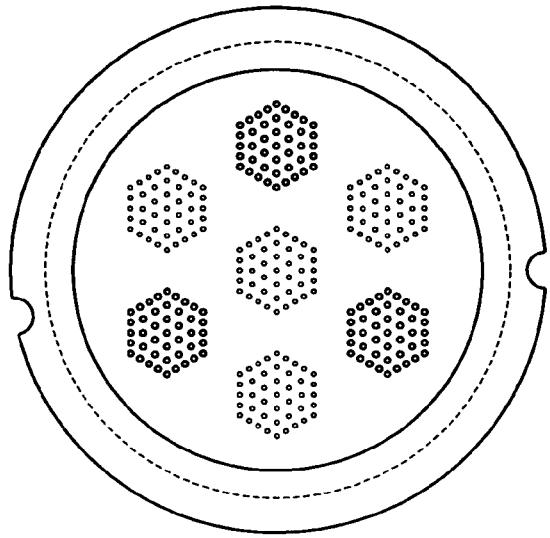
Figure 2D:
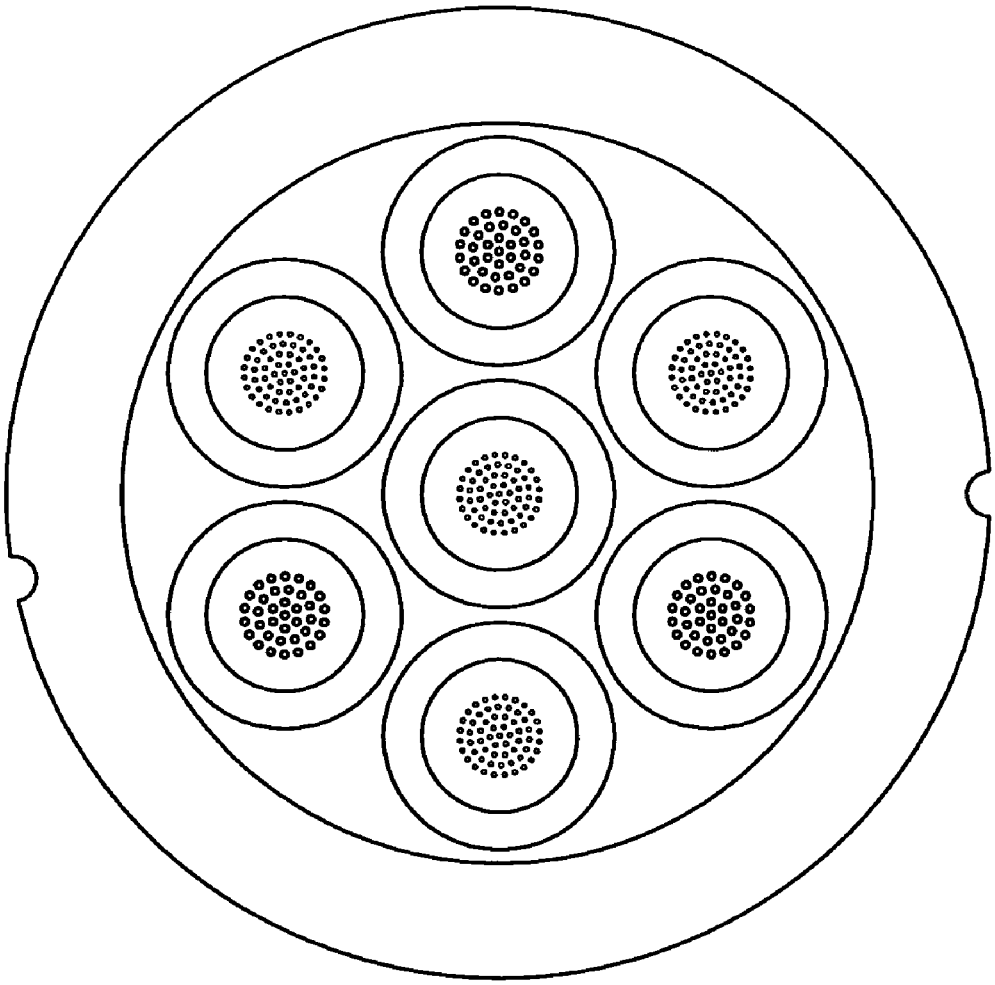
Figure 2E:
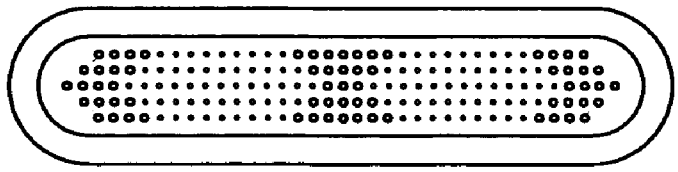

PB: polypyridobisimidazole, represented by the formula:

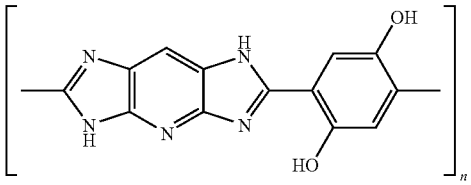

wherein N is a nitrogen atom, H is a hydrogen atom, and O is an oxygen atom. The number of repeating units, n, is not critical. Preferably, each polymer chain has from 10 to 25,000 repeating units, n.

dpf: denier per filament

Da: Dalton, unit of molecular weight

DEFINITIONS

For purposes herein, the term "filament" is defined as a relatively flexible, macroscopically homogeneous body having a high ratio of length to width across its cross-sectional area perpendicular to its length. The filament cross section can be any shape, but is typically circular. Herein, the term "fibre" is used interchangeably with the term "filament".

The expressions "larger", "smaller", "largest", "smallest" and "medium" in relation to a filament or plurality of filaments refers to the average diameter or linear density of the filament or plurality of filaments.

"Diameter" in reference to a filament is the diameter of the smallest circle that can be drawn to circumscribe the entire cross-section of the filament. In reference to a hole in a spinneret, it refers to the smallest circle that can be drawn to circumscribe the hole.

"Denier" the weight in grams per 9,000 m length of filament or yarn.

"Tex" the weight in grams of one kilometer of filament or yarn.

"Decitex" one tenth of a Tex.

The expressions "capillary" and "extrusion hole" are used interchangeably to mean the holes through which polymer is extruded in the formation of filaments.

Yarns

The yarns of the invention, having mixed average diameter filaments, show increased cut- and abrasion-resistance, as compared to conventional yarns comprising filaments of a single average diameter. It is believed that the mixed diameter arrangement has excellent cut- and abrasion-resistance for two main reasons:

(1) The arrangement of thin filaments with thick filaments permits "rolling" of the filaments with respect to one another, thus dissipating the attacking force;

(2) The arrangement of thin filaments with thick filaments permits increased packing, thus increasing the density of the yarn, providing more material to resist the attacking force.

The inventors have chosen to refer to the yarns of the invention as being made of filaments having different average diameters. The expression "average diameter" can be replaced with the expression "linear density" for an alternate definition of the yarns of the invention. It is equally possible to refer to the yarns of the invention as being made up of filaments having different linear densities. The yarns of the invention may be referred to as "mixed filament yarns", "mixed denier yarns" and/or "mixed dtex yarns".

For p-aramid (e.g., Kevlar®), average diameter of a filament can be converted to linear density approximately as shown below:

Relationship between average diameter of filament and linear density for p-aramid

| Average diameter of filament (microns) | Approximate equivalent linear density in denier per filament (dpf) |
|---|---|
| 8 | 0.7 |
| 12 | 1.5 |
| 16 | 2.7 |

Polymer

The yarns of the present invention may be made with filaments made from any polymer that produces a high-strength fibre, including, for example, polyamides, polyolefins, polyazoles, and mixtures of these.

When the polymer is polyamide, aramid is preferred. By aramid is meant a polyamide wherein at least 85% of the amide (—CONH—) linkages are attached directly to two aromatic rings. Suitable aramid fibres are described in Man-Made Fibres—Science and Technology, Volume 2, Section titled Fibre-Forming Aromatic Polyamides, page 297, W. Black et al., Interscience Publishers, 1968. Aramid fibres and their production are, also, disclosed in U.S. Pat. Nos. 4,172,938; 3,869,429; 3,819,587; 3,673,143; 3,354,127; and 3,094,511.

The preferred aramid is a para-aramid. The preferred para-aramid is poly(p-phenylene terephthalamide) which is called PPD-T. By PPD-T is meant the homopolymer resulting from mole-for-mole polymerization of p-phenylene diamine and terephthaloyl chloride and, also, copolymers resulting from incorporation of small amounts of other diamines with the p-phenylene diamine and of small amounts of other diacid chlorides with the terephthaloyl chloride. As a general rule, other diamines and other diacid chlorides can be used in amounts up to as much as about 10 mole percent of the p-phenylene diamine or the terephthaloyl chloride, or perhaps slightly higher, provided only that the other diamines and diacid chlorides have no reactive groups which interfere with the polymerization reaction. PPD-T, also, means copolymers resulting from incorporation of other aromatic diamines and other aromatic diacid chlorides such as, for example, 2,6-naphthaloyl chloride or chloro- or dichloroterephthaloyl chloride or 3,4'-diaminodiphenylether.

Additives can be used with the aramid and it has been found that up to as much as 10 percent or more, by weight, of other polymeric material can be blended with the aramid. Copolymers can be used having as much as 10 percent or more of other diamine substituted for the diamine of the aramid or as much as 10 percent or more of other diacid chloride substituted for the diacid chloride or the aramid.

When the polymer is polyolefin, polyethylene or polypropylene are preferred. By polyethylene is meant a predominantly linear polyethylene material of preferably more than one million molecular weight that may contain minor amounts of chain branching or comonomers not exceeding 5 modifying units per 100 main chain carbon atoms, and that may also contain admixed therewith not more than about 50 weight percent of one or more polymeric additives such as alkene-1-polymers, in particular low density polyethylene, propylene, and the like, or low molecular weight additives such as anti-oxidants, lubricants, ultra-violet screening agents, colorants and the like which are commonly incorporated. Such is commonly known as extended chain polyethylene (ECPE) or ultra high molecular weight polyethylene (UHMWPE). Preparation of polyethylene fibers is discussed in U.S. Pat. Nos. 4,478,083, 4,228,118, 4,276,348 and Japanese Patents 60-047,922, 64-008,732. High molecular weight linear polyolefin fibres are commercially available. Preparation of polyolefin fibres is discussed in U.S. Pat. No. 4,457,985.

When the polymer is polyazole, suitable polyazoles are polybenzazoles, polypyridazoles and polyoxadiaoles. Suitable polyazoles include homopolymers and, also, copolymers. Additives can be used with the polyazoles and up to as much as 10 percent, by weight, of other polymeric material can be blended with the polyazoles. Also copolymers can be used having as much as 10 percent or more of other monomer substituted for a monomer of the polyazoles. Suitable polyazole homopolymers and copolymers can be made by known procedures, such as those described in U.S. Pat. Nos. 4,533,693 (to Wolfe, et al., on Aug. 6, 1985), 4,703,103 (to Wolfe, et al., on Oct. 27, 1987), 5,089,591 (to Gregory, et al., on Feb. 18, 1992), 4,772,678 (Sybert, et al., on Sep. 20, 1988), 4,847,350 (to Harris, et al., on Aug. 11, 1992), and 5,276,128 (to Rosenberg, et al., on Jan. 4, 1994).

Preferred polybenzazoles are polyzimidazoles, polybenxothiazoles, and polybenzoxazoles. If the polybenzazole is a polyzimidazoles, preferably it is poly[5,5'-bi-1H-benzimidazole]-2,2'-diyl-1,3-phenylene which is called PBI. If the polybenzazole is a polybenxothiazole, preferably it is a polybenxobisthiazole and more preferably it is poly(benxo[1,2-d:4,5-d']bisthiazole-2,6-diyl-1,4-phene which is called PBT. If the polybenzazole is a polybenzoxazole, preferably it is a polybenzobisoxazole and more preferably it is poly (benzo[1,2-d:4,5-d']bisoxazole-2,6-diyl-1,4-phenylene which is called PBO.

Preferred polypyridazoles are rigid rod polypyridobisazoles including poly(pyridobisimidazole), poly(pyridobisthiazole), and poly(pyridobisozazole). The preferred poly(pyridobisozazole) is poly(1,4-(2,5-dihydroxy)phenylene-2,6-pyrido[2,3-d:5,6-d']bisimidazole which is called PB. Suitable polypyridobisazoles can be made by known procedures, such as those described in U.S. Pat. No. 5,674,969.

Preferred polyoxadiaoles include polyoxadizaole homopolymers and copolymers in which at least 50% on a molar basis of the chemical units between coupling functional groups are cyclic aromatic or heterocyclic aromatic ring units. A preferred polyoxadizaole is Oxalon®.

Method and Spinnerets

The continuous filament mixed diameter yarns of the invention are made using a spinneret having holes of different diameters. Holes of smaller diameter will yield lower diameter filaments, and holes of larger diameter will yield larger diameter filaments. The arrangement of the larger holes with respect to the smaller holes in the spinneret is not of particular importance, however, it is advantageous to have smaller diameter filaments sandwiched between larger diameter filaments, as this maximizes rolling action of the filaments. In a preferred arrangement, the arrangement of holes in the spinneret is in the form of concentric circles, the whole forming a large circular array of holes. The holes toward the centre of the array are the smaller diameter holes, and those towards the circumference of the array are the larger diameter holes. Examples of different kinds of spinneret hole arrangements are shown in FIGS. 2A-E and 4. The arrangement shown in FIG. 4 has filaments arranged in concentric order from the centre as follows: medium capillaries then small ones then medium again and finally large capillaries at the periphery. This provides a very stable yarn in terms of segregation and stability during processing. The smaller filaments are "squeezed" in the two layers of larger ones. The pressure distribution in this configuration is more favorable to spinning without dripping.

The cross-section of the filaments used in the yarn of the invention may be, for example, circular, elliptical, multilobed, "star-shaped" (refers to an irregular shape having a plurality of arms coming off a central body), and trapezoidal. The holes in the spinneret are chosen according to the desired filament diameter and cross-section.

The "linear density" of the filament is determined by the rate (mass/time) at which polymer is extruded through a spinneret hole vs. the rate (speed, or linear distance/time) at which the filament is produced. The size (diameter) of the filament is a function of the polymer density and the fiber "linear density". The number of holes in a spinneret (or section of a spinneret) is determined by the number of filaments desired in the final fiber bundle ("linear density" of which is the sum of the individual filaments contained therein). The size and shape of each hole in the spinneret is influenced by the pressure-drop, shear, spin-stretch, and orientation needed to produce the desired filament diameter. In a preferred embodiment of the p-aramid spinneret, the smaller holes have a diameter of between at or about 35-65 microns, more preferably at or about 50 microns, and the larger holes have a diameter between at or about 60 to 90 microns, more preferably at or about 64 microns. Preferably the ratio between the diameter of the larger holes to that of the smaller holes is at or about 1.2 to at or about 3, more preferably at or about 1.3 to 2.5. To make a yarn having three different diameter filaments, a spinneret may be used, for example, in which the holes are in the following ranges: smallest 35 to 65 microns (preferably 45-55 microns), medium 64-80 microns, largest 75 to 90 microns.

The spinneret is made of material suited to the polymer or polymer solution or suspension that will be spun. For p-aramid spun from concentrated $H_2SO_4$, preferred material are tantalum, tantalum-tungsten alloys, and gold-platinum (rhodium) alloys. Other materials which may be used include high grade stainless steels [i.e., with a high chromium (>15 wt %) and/or nickel (>30 wt %) content], such as Hastelloy® C-276, ceramics and nanostructures made with ceramics. p-Aramid spinnerets may also be made from mixed materials, such as pure tantalum clad on a tantalum-tungsten alloy. Materials other than tantalum can be used for the cladding layer so long as they have the required corrosion resistance and annealed yield strengths of less than 30,000 psi (2,110 kg/cm$^2$). Among such suitable materials, listed in order of increasing hardness, are gold, M-metal (90% gold/10% rhodium by weight), C-metal (69.5% gold/30% platinum/0.5% rhodium by weight), D-metal (59.9% gold/40.0% platinum/0.1% rhenium by weight), and Z-metal (50.0% gold/49.0% platinum/1.0% rhodium by weight). The latter was substantially the same hardness as tantalum. Also suitable is a 75% gold/25% platinum alloy. All of these metals are, however, much more expensive than tantalum. All but Z-metal are much more easily damaged in use than tantalum. Softer materials are advantageous, however, when capillaries of quite high L/D ratio (e.g., greater than 3.5) are to be formed.

The polymer is extruded, either as a solution, suspension or melt, through the spinneret, and the resulting filaments are spun into yarn and treated in a manner suitable for the particular polymer.

Alternatively, the mixed dtex yarns of the invention can be made by "off-line assembly", that is, the different denier filaments can be assembled after spinning. However, off-line assembly is less preferred than direct spinning (i.e., using a spinneret having different size holes to produce directly a yarn having mixed dtex filaments), since it can lead to segregation of the filaments of different diameters, resulting in a non-homogeneous yarn which has less resistance to attacking forces.

A group of filaments may be classified as having the same average diameter if the deviation of the average diameter of any filament in the group from the average is less than at or about 0.4 micron.

In a preferred embodiment, two sizes of filaments make up the yarn. In this case, it is preferred that the smaller filaments have an average diameter in the range of at or about 8 to 22 microns, and the larger filaments have an average diameter in the range of at or about 16 to 32 microns. Although these ranges overlap, it is understood that the smaller and larger filaments are chosen to have different average diameters, such that the average diameter of the smaller filaments is smaller than the average diameter of the larger filaments. For example, included in the invention is a yarn having smaller filaments with average diameter of at or about 8 microns together with larger filaments having average diameter of at or about 16 microns, and a yarn having smaller filaments with average diameter of at or about 22 microns together with larger filaments having average diameter of at or about 32 microns.

In yarns consisting of two sizes of filaments, it is preferred that the smaller filaments not differ from the larger filaments by more than a factor of at or about 2, more preferably not more than a factor of at or about 1.5. If the filaments differ too much in size, segregation can occur, leading to nonhomogeneity and reduced cut-resistance. Preferably the ratio of the diameter of the larger filaments to the smaller filaments is at or about 1.3-1.5.

In those embodiments in which the yarn is made up of filaments having two different average diameters, the second plurality of filaments (i.e., larger average diameter) make up from at or about 20 to 60% (by number) of the filaments in the yarn, and the first plurality of filaments (i.e., smaller diameter) make up from at or about 40 to 80% (by number) of the filaments in the yarn. More preferably the larger diameter filaments make up from at or about 45 to 55% (by number) of the filaments in the yarn, and the smaller diameter filaments make up from at or about 45 to 55% (by number) of the filaments in the yarn.

In another preferred embodiment, three sizes of filaments make up the yarn. In this case, it is preferred that the smallest filaments have an average diameter in the range of at or about 4 to 10 microns (more preferably at or about 6 to 9 microns), the medium filaments have an average diameter in the range of at or about 10 to 13 microns, and the largest filaments have an average diameter in the range of at or about 14 to 18 microns. For example, an advantageous result is obtained with a yarn made up of filaments having the following average diameters: 8, 12 and 16 microns. In those yarns having three sizes of filaments, preferably the ratio of the average diameter of smallest:medium:largest is at or about 2:6:8, more preferably at or about 2:3:4.

In those embodiments in which the yarn is made up of filaments having three different average diameters (linear densities), the third plurality of filaments (i.e., the largest) make up at or about 15 to 35% (by number) of the filaments in the yarn, the second plurality of filaments (i.e., the medium) make up at or about 30 to 45% (by number) of the filaments in the yarn, and the first plurality of filaments (i.e., the smallest) make up from at or about 30 to 45% (by number) of the filaments in the yarn.

In other preferred embodiments, the yarn of the invention is made up of four, five, six or more sizes of filaments.

In a further embodiment, referred to as "continuous", the yarn of the invention consists of a largest filament or group of filaments (e.g., average diameter of at or about 15-40 microns) and a smallest filament or group of filaments (e.g. average diameter of at or about 4-25 microns) wherein the largest filament (or group of filaments) and the smallest filament (or group of filaments) have different average diameters, and a plurality of filaments having average diameters distributed between the average diameter of the largest filament and the smallest filament. With such an arrangement, very high packing densities (>90%) can be obtained, resulting in highly cut-resistant yarns.

The size of the holes in the spinneret influences the average diameter of the extruded filaments. The tension used to draw the filaments (drawing) also influences the average diameter of the filaments and the characteristics of the finished yarn. Drawing reduces the average diameter of the filaments.

By adjusting the velocity of the fibre as it leaves the coagulating bath to higher than the velocity of the polymer as it emerges from the spinning holes one can adjust various physical properties of the filament such as its tenacity, modulus and elongation, and also its diameter. The ratio of the two speeds here referred to, is called spin-stretch in p-aramids in which the filament is set in the coagulation batch and drawing ratio when referring to a fiber such as UHMWPE which is extended substantially after the fiber is quenched. High drawing ratio achievable with UHMWPE can reach up to 50-100 times. With p-aramid a typical spin-stretch ratio is approximately 2 to 14.

The filaments making up the yarns of the invention may have a substantially circular cross-section. A circular cross-section maximizes the "rolling" of the filaments with respect to each other, thus maximizing cut-resistance. A circular cross-section also maximizes the packing density, also beneficial for cut-resistance. In alternative embodiments, the cross-section of the filaments may be elliptical. It is also possible for the smaller filaments to be circular in cross-section and the large filaments to be elliptical in cross-section, or vice versa. The cross-section of the filaments is influenced by the shape of the holes in the spinneret, with round holes resulting in a circular cross-section, and elliptical holes resulting in an elliptical cross-section. It is also influenced by the internal capillary shape, grooves and channels parallel or helicoidally arranged. Further, it is influenced by the coagulation process; for instance, m-aramid (e.g., Nomex®) filaments typically have a two-lobe "dog-bone" shape when dry spun, or are multi-lobed, or "star shaped" when wet spun, since the skin is solidified before the solvent is extracted from the core, and the contracted area does not "fill" the perimeter.

The yarn of the invention preferably has a tenacity of at or about 15 to 40 g/denier, more preferably at or about 25 to 35 g/denier.

The yarn of the invention preferably has an elongation at break of at or about 1.5 to 15%, more preferably at or about 2 to 4%.

The yarn of the invention preferably has a modulus of elasticity of at or about 5 to 450 N/tex, more preferably at or about 50 to 400 N/tex.

In a preferred embodiment, the yarn of the invention has a tenacity of at or about 25 to 35 g/denier, an elongation at break of from at or about 2 to 4%, and a modulus of elasticity of from at or about 50 to 400 N/tex.

The number of filaments making up the yarn of the invention is not limited, and depends on the end-use, and the linear density required in the final yarn. Typical yarns comprise from 16 to 1500 total filaments. In a preferred embodiment, the total number of filaments in the yarn is 276, of which 45-55% (in number) are the smaller filaments and 45-55% (in number) are the larger filaments.

In yarns of the invention having a third plurality of filaments, with greater average diameter than the first and second plurality of filaments, an example would be 276 total filaments in the yarn, with 25-50% (by number) being the smallest filaments, 25-50% (by number) being the medium filaments and 15-35% (by number) being the largest filaments.

The yarn of the invention preferably has a maximum possible packing density of at or about 80 to 95%, more preferably at or about 90 to 95%. Cross section and packing density can be measured by immobilizing the fibre under a relatively small tension in an epoxy resin placed in a cylindrical mould perforated at the bottom to allow passage of the fibre flow of the resin. The molded sample is then cured at room temperature for 12 hours. The sample is then frozen in liquid nitrogen for one minute and a cut transverse to the fibre axis is made to realize image analysis and diameter measurement and void ratio evaluation under SEM microscope enlargement. The sample preparation used is well know for scanning microscopy except that polishing is avoided.

Packing density is influenced by the relative diameters (i.e., linear density) of the filaments, and the ratio of the number of first plurality of filaments (i.e., smaller) to the number of the second plurality of filaments (i.e., larger). Yarns having a ratio of first plurality of filaments to second plurality of filaments of at or about 0.5 (i.e., 50% by number smaller filaments and 50% by number larger filaments), and a large difference in average diameter between the filaments (large:small at or about 2) will typically have a high packing density (e.g., preferably greater than 90%, typically 90 to 95%). In addition, yarns made in the "continuous" embodiment also have high packing densities.

With a filament mix comprising 57 filaments of 12 micron in the centre, 115 filaments of 8 micron concentrically positioned around the first layer, then another 58 filaments of 12 micron concentrically positioned around the second layer and 46 filaments of 16 micron externally positioned around the third layer, one can obtained a packing density of approximately 90%.

The yarn of the invention is particularly suited to making cut-, abrasion- and penetration-resistant fabrics, having excellent comfort characteristics. Such fabrics may be made by braiding, knitting or weaving techniques known in the art. Fabrics made from the yarns of the invention may be used for making cut-, abrasion- and penetration-resistant garments, for example, gloves, footwear, coveralls, trousers and shirts, as well as parts of garments that require particular cut-, abrasion- and penetration-resistance, such as the palms of gloves, cuffs of trousers, coveralls or shirts. Such articles may be coated with various resins and elastomers.

Additionally, yarns of the invention may be incorporated in unidirectional protective structures, in which largely unidirectional (parallel) yarns are imbedded or partially imbedded in an immobilizing medium, such as a resin and elastomers.

EXAMPLES

Temperature: All temperatures are measured in degrees Celsius (° C.).

Denier is determined according to ASTM D 1577 and is the linear density of a fibre as expressed as weight in grams of 9000 meters of fibre. The denier can be measured on a Vibroscope from Textechno of Munich, Germany. Denier times (10/9) is equal to decitex (dtex).

Method for Making Yarn

Referring to FIG. 1, in a process described at (10), a yarn according to the invention was made using as polymer a batch solution preparation of poly-para-phenylene terephthalamide containing 4.5 kg of polymer. 18.6 kg of acid were pumped into a mixer and cooled to −22° C. while being agitated to form a frozen slush in a nitrogen atmosphere (12). One-half to one-third of the polymer was initially added and mixed for ten minutes before the remaining amount of polymer was added. The jacket surrounding the mixer was then heated to 87° C. (14). Once the solution had maintained that temperature for an hour and a half, the mixer agitator and the vacuum pump were shut off, and the mixer was pressurized to 1.7 bar (absolute) with nitrogen.

Figure 3:
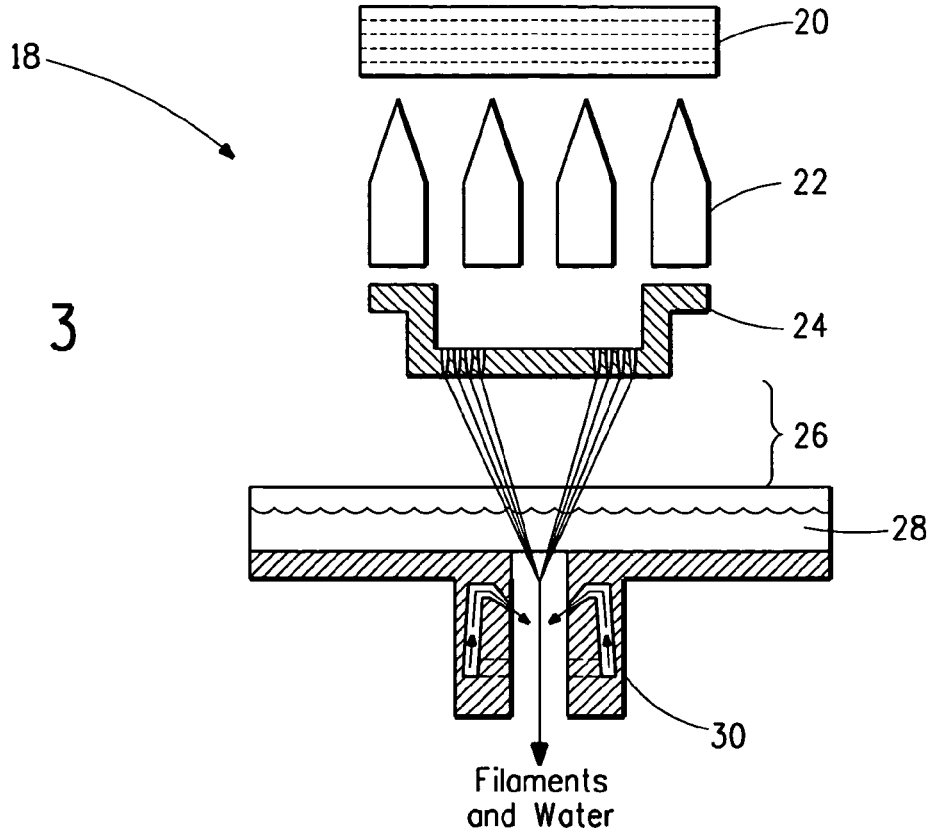
FIG. 3 illustrates one embodiment of a spinneret pack.

After the polymer solution batch was made, a 5 $cm^3$ meter pump (16) was used to transfer the solution through a flow plate (22) and a screen pack (20), shown in FIG. 3 at (18), to the spinning process, which operated at 460 m/min. A 276 hole spinneret (24), shown in FIG. 4, was used to spin the yarn. For the yarn of the invention, the spinneret had 46 holes with a 76μ capillary diameter (24*a*), 115 holes with a 64μ capillary diameter (24*b*), 115 holes with a 51μ capillary diameter (24*c*), and the hole arrangement is shown in FIG. 4.

Referring to FIG. 3, the filaments were spun through a 6 mm air gap (26) before entering a 3° C. quench bath (28) water and passing through a quench jet (30) (6.4 mm diameter radial jet with a 0.2 mm gap). The jet and tray flows for the quench bath were set to 2.3 l/min. and 5.3 l/min. respectively. Referring to FIG. 1, after the yarn was quenched, it was conveyed to an acid wash of water (32). There were 30 wraps on a pair of 113 mm diameter rolls (34) with a centreline spacing of 445 mm. The water flow was 15 l/min. and the tension was between 0.7 and 1.0 g/denier (0.0.8 and 1.1 g/dtex). After the acid wash, the yarn moved on to a further wash cabinet (36) where there were also 30 wraps on a pair of rolls with the same diameter and centreline spacing as the acid wash rolls. The first half of the wash cabinet was a caustic wash (38) (consisting of sodium hydroxide solution), and the second half was a water wash (40). The strong and dilute caustic flows for the caustic wash were each 7.5 l/min., and the tension was between 0.5 and 0.8 g/denier (0.55 and 0.89 g/dtex). The yarn was then dried at 311° C. with 34 wraps on a pair of 160 mm diameter rolls (42) with a centreline spacing of 257 mm. After the yarn was dried, a finish was applied (44) and it was wound on a packaging roll (46).

Inventive Sample

Figure 4:
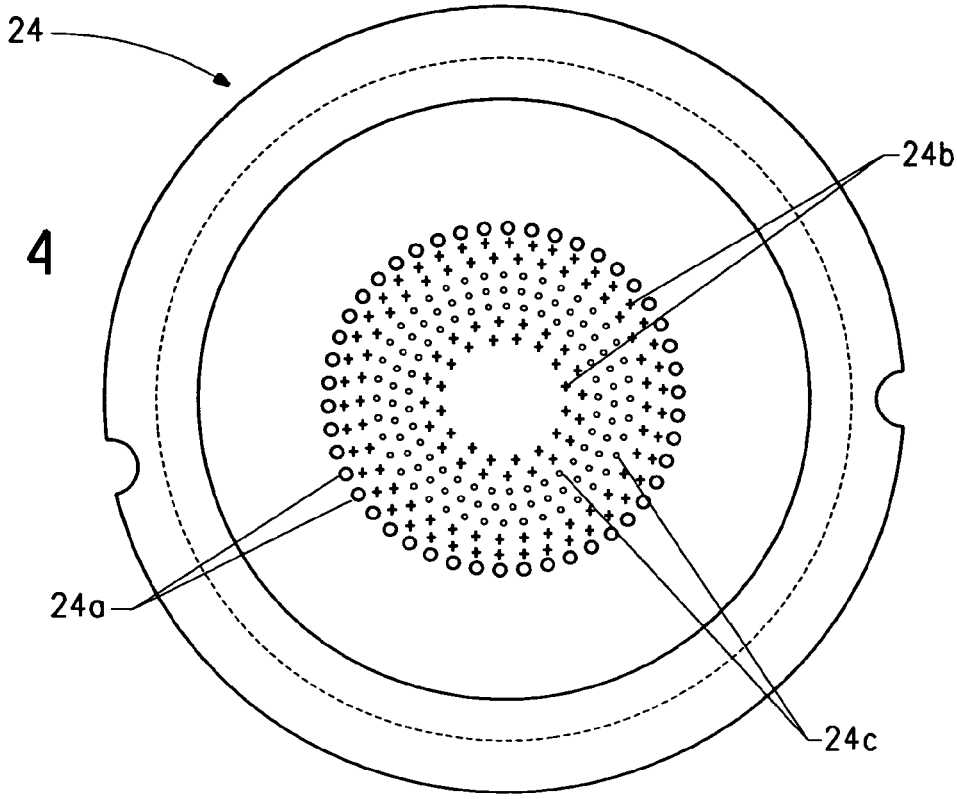
FIG. 4 shows a spinneret according to the invention as used in the Example.

The inventive sample was made from a yarn of 400 denier out of a spinneret as depicted in FIG. 4, as follows:

46 capillaries yielding 2-2.6 dpf (about 16 micron in diameter) filaments (24*a*);

115 capillaries yielding 1.5 dpf (about 12 micron in diameter) filaments (24*b*); and 115 capillaries yielding 0.65-1 dpf (about 8 micron in diameter) filaments (24*c*).

The yarn was knitted to yield a sample of areal density of about 400 g/m$^2$.

Control Sample

The control sample was made using yarn made exactly as specified above, but the spinneret had only one size hole and yielded only 1.5 dpf (about 12 micron in diameter) filaments. The resulting yarn was 400 denier and consisted exclusively of 1.5 dpf filaments. The yarn was knitted to yield a sample of areal density of about 400 g/m$^2$.

Testing of the Yarn of the Invention

Cut Resistance

Abrasive Cut Procedure

The abrasive cut testing procedure was based on the EN388:1994 (Protective gloves against mechanical risks) current procedure, which was modified in terms of the weight force applied onto the circular blade, i.e., instead of a 5N equivalent force a 2.9N equivalent force was applied, thereby permitting an increased number of cut cycles, which promotes abrasion.

The procedure is described in the EN document. It can be summarized as follows:

Two layers of a rectangular shaped sample (approx. 80 by 100 mm), one on the top of the other, were tested simultaneously. A load of 2.9N instead of 5N was positioned in its dedicated position. The test specimen sat on a support covered by a conductive rubber. The horizontal movement of the circular rotating blade was 50 mm long. The resulting linear peripheral speed was 10 cm/s. The cut tester was equipped with an automated electro-conductive system, which detected cuts throughout the specimen.

The blade sharpness was checked at the beginning and between each sample testing using a cotton standard fabric as per specification of EN388-1994 procedure.

Based on the number of cycles and a proposed calculation, provided in the EN388-1994, a cut level was computed, whereby a cut level between 0 to 5 was determined, 0 being the lowest achievable cut protection level, and 5 being the highest.

RESULTS

The inventive sample required more than 300 cycles to cut through, whereas the control one made of 100% identical filaments required less than 150 cycles to cut through.

What is claimed is:

1. A yarn, comprising:

a first plurality of continuous filaments, each of the first plurality of filaments having an average diameter in the range of at or about 2 to 25 microns/filament;

at least a second plurality of continuous filaments, each of the second plurality of filaments having an average diameter greater than the average diameter of the first plurality of filaments, and in the range of at or about 10 to 40 microns/filament; and the first and second plurality of filaments being made of the same polymer selected from the group consisting of an aromatic polyamide, a polyolefin polypyridobisimidazole and an aromatic polyazole.

2. The yarn of claim 1, wherein the polymer is an aromatic polyamide.

3. The yarn of claim 1, wherein the polymer is an aromatic polyazole.

4. The yarn of claim 1, wherein the polymer is poly(p-phenylene terephthalamide).

5. The yarn of claim 1, wherein the polymer is polypyridobisimidazole.

6. The yarn of claim 1, consisting of filaments having three different average diameters, wherein the smallest filaments have an average diameter of at or about 4 to 10 microns, the medium filaments have an average diameter of at or about 10 to 13 microns, and the largest filaments have an average diameter in the range of at or about 14 to 18 microns.

7. The yarn of claim 1, consisting of filaments having two different average diameters, wherein the first plurality of filaments represents at or about 40 to 80% by number of the filaments in the yarn.

8. The yarn of claim 1, consisting of filaments having three different average diameters, and the smallest filaments make up at or about 30 to 45% by number of the filaments in the yarn, the medium filaments make up at or about 30 to 45% by number of the filaments in the yarn, and the largest filaments make up at or about 15 to 35% by number of the filaments in the yarn.

9. The yarn of claim 1, comprising filaments of two different average diameters, wherein the ratio of the average diameter of the larger filaments to the average linear density of the smaller filaments is between at or about 1.3 to 1.5.

10. The yarn of claim 1, comprising filaments having a substantially circular cross-section.

11. The yarn of claim 1, having a packing density of at or about 85 to 95%.

12. A cut-resistant fabric comprising the yarn of claim 1.

13. A cut-resistant garment, comprising the yarn of claim 1.

14. A unidirectional protective structure, comprising the yarn of claim 1.

15. A yarn according to claim 1, comprising:

a first filament, or group of filaments, having an average diameter in the range of at or about 4 to 25 microns;

a second filament, or group of filaments, having an average diameter greater than the average diameter of the first filament, and in the range of at or about 15 to 40 microns/filament; and a plurality of filaments having average diameters distributed between the average diameter of the first filament and the average diameter of the second filament;

wherein all of the filaments are made of the same polymer selected from the group consisting of an aromatic polyamide, a polyolefin polypyridobisimidazole and an aromatic polyazole.

16. A method for making a cut-resistant yarn comprising:

a first plurality of continuous filaments, each of the first plurality of filaments having an average diameter in the range of at or about 2 to 25 microns/filament;

at least a second plurality of continuous filaments, each of the second plurality of filaments having an average diameter greater than the average diameter of the first plurality of filaments, and in the range of at or about 10 to 40 microns/filament; and the first and second plurality of filaments being made of the same polymer selected from the group consisting of an aromatic polyamide, a polyolefin, polypyridobisimidazole and an aromatic polyazole, comprising the step of: extruding polymer selected from an aromatic polyamide, a polyolefin polypyridobisimidazole and an aromatic polyazole from a spinneret comprising a plurality of extrusion holes of a first average diameter and a plurality of extrusion holes having a second average diameter, wherein the first and second average diameters differ by a factor of at least 1.2.

17. The method of claim 16, wherein the polymer is an aromatic polyamide.

18. The method of claim 16, wherein the polymer is an aromatic polyazole.

19. The method of claim 16, wherein the polymer is poly (p-phenylene terephthalamide).

20. The method of claim 16, wherein the polymer is polypyridobisimidazole.

* * * * *